US006391504B2

(12) United States Patent
Tai et al.

(10) Patent No.: US 6,391,504 B2
(45) **Date of Patent: *May 21, 2002**

(54) PROCESS FOR PREPARING PHOSPHOR PATTERN FOR FIELD EMISSION DISPLAY PANEL, PHOTOSENSITIVE ELEMENT FOR FIELD EMISSION DISPLAY PANEL, PHOSPHOR PATTERN FOR FIELD EMISSION DISPLAY PANEL AND FIELD DISPLAY PANEL

(75) Inventors: Seiji Tai; Yoshiyuki Horibe, both of Hitachi; Hiroyuki Tanaka, Mito; Takeshi Nojiri, Ibaraki-ken; Kazuya Satou, Hitachi; Naoki Kimura, Hitachi; Mariko Shimamura, Hitachi, all of (JP)

(73) Assignee: Hitachi Chemical Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/083,057

(22) Filed: May 22, 1998

(30) Foreign Application Priority Data

May 22, 1997 (JP) ..... 9-132254

(51) Int. Cl.[7] ..... H01J 9/22; H01J 9/227

(52) U.S. Cl. ..... 430/26; 430/25; 430/23; 445/24; 445/10; 445/11; 313/496; 313/422

(58) Field of Search ..... 313/422, 495, 313/496, 497; 430/23, 25, 26; 445/24, 10, 11

(56) References Cited

U.S. PATENT DOCUMENTS

| | | | | |
|---|---|---|---|---|
| 3,753,710 A | | 8/1973 | Jones et al. | 96/36.1 |
| 4,505,999 A | * | 3/1985 | Bergamo et al. | 430/23 |
| 4,965,091 A | * | 10/1990 | Frarello et al. | 427/64 |
| 5,614,785 A | * | 3/1997 | Wallace et al. | 313/496 |
| 5,869,928 A | * | 2/1999 | Liu et al. | 313/495 |
| 5,998,085 A | * | 12/1999 | Isberg et al. | 430/25 |
| 6,194,826 B1 | * | 2/2001 | Satou et al. | 430/24 |

FOREIGN PATENT DOCUMENTS

| | | | |
|---|---|---|---|
| EP | 0768573 | 4/1997 | G03F/7/004 |
| EP | 0785565 A1 | 7/1997 | H01J/9/227 |
| EP | 0865067 | 9/1998 | H01J/9/227 |
| JP | 1-115027 | 5/1989 | H01J/9/02 |
| JP | 1-124929 | 5/1989 | H01J/9/02 |
| JP | 1-124930 | 5/1989 | H01J/9/02 |
| JP | 2-155142 | 6/1990 | H01J/9/22 |
| WO | WO97/31387 | 8/1997 | H01J/9/227 |

OTHER PUBLICATIONS

Patent Abstracts of Japan, Publication No. 01272027—Publication Date Oct. 1989.
Patent Abstracts of Japan, Publication No. 04322036—Publication Date Nov. 1992.
Patent Abstracts of Japan, Publication No. 09244230—Publication Date Sep. 1997.

* cited by examiner

*Primary Examiner*—Martin Angebranndt
(74) *Attorney, Agent, or Firm*—Antonelli, Terry, Stout & Kraus, LLP

(57) ABSTRACT

A phosphor pattern for a field emission display panel (FED) is provided. The phosphor pattern is formed by a process whichh comprises the steps of: (I) forming (A) a photosensitive resin composition layer containing a phosphor on a substrate to which a conductive layer is formed; (II) selectively irradiating active light to (A) the photosensitive resin composition layer containing a phosphor, for forming a pattern; (III) selectively removing (A) the photosensitive resin composition layer to which active light has been selectively irradiated by development, to form the pattern; and (IV) calcining the pattern to remove an unnecessary portion, to form the phosphor pattern. Also provided ar this process for forming the phosphor pattern, a photosensitive element for a FED and a field emission display panel. In forming the layer on the substrate, the photosensitive resin composition layer can be provided as a layer of a photosensitive element, and the element provided on the substrate such that the layer contacts the substrate.

13 Claims, 4 Drawing Sheets

FIG. 3(III)
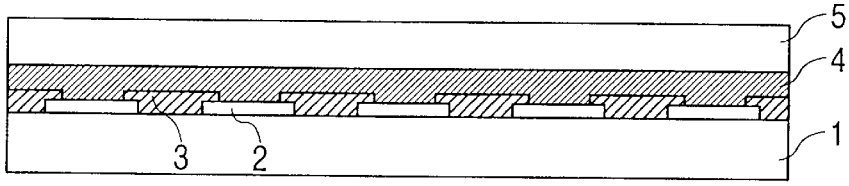
FIG. 3(VII)
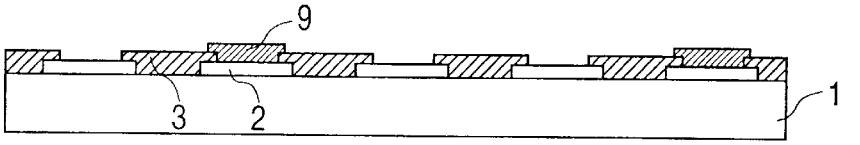

FIG. 4(III)
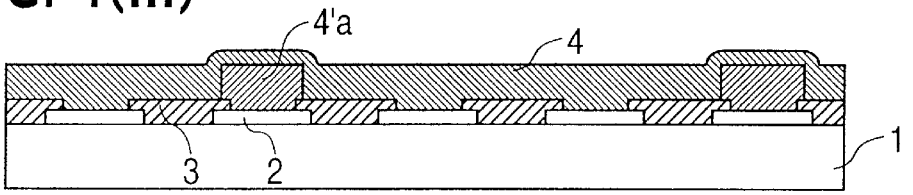

PROCESS FOR PREPARING PHOSPHOR PATTERN FOR FIELD EMISSION DISPLAY PANEL, PHOTOSENSITIVE ELEMENT FOR FIELD EMISSION DISPLAY PANEL, PHOSPHOR PATTERN FOR FIELD EMISSION DISPLAY PANEL AND FIELD DISPLAY PANEL

BACKGROUND OF THE INVENTION

This invention relates to a process for preparing phosphor pattern for a field emission display panel, a photosensitive element for a field emission display panel, a phosphor pattern for a field emission display panel and a field emission display panel.

In the prior art, as one of flat plate display panels, there has been known a field emission display panel (hereinafter referred to as "FED") which enables multi-color display panel by providing a phosphor which emits light by colliding thereto electrons emitted from metal surface or a semiconductor surface while applying an electric field.

In recent years, accompanying with the progress of a semiconductor fine patterning technique, a number of fine field electron-emitting emitters can be formed on a Si wafer or a glass substrate with good reproducibility.

According to this progress, field emission can be realized by applying a voltage with several ten volts without applying a high voltage.

FED is a display element in which a cathode substrate to which emitters are formed and an anode substrate to which a fluorescent surface is formed are opposed to each other in a vacuum sealed apparatus and which emits light by electron beam excitation.

FED can be called as a flat CRT having a number of plane electron guns on a flat plane, and in view of many advantages of a thickness of about 2 mm, spontaneous light displaying quality as that of CRT, a wide view filed angle of about 170°, a quick response rate of $\mu$sec order, environmental resistance as that of a vacuum tube and a low consumed power not more than TFT-LCD, it has been expected to use as a wide screen display panel.

In the prior art, as a method for forming the phosphor, a method of coating a slurry liquid or a paste in which phosphors of the respective colors are dispersed is coated by a printing method such as screen printing has been proposed and disclosed in Japanese Provisional Patent Publications No. 115027/1989, No. 124929/1989, No. 124930/1989 and No. 155142/1990. It has also been known that an adhesive property of a specific portion is changed and a portion to which a phosphor is to be adhered is selected whereby three colors of R, G and B are separately formed.

However, the above-mentioned phosphor-dispersed slurry liquid is a liquid state so that dispersion failure is likely caused by sedimentation of phosphors, etc. Also, when a liquid state photosensitive resist is used as the slurry liquid, there is a defect of markedly lowering in preservation stability with the progress of dark reaction. Moreover, to cope with enlargement of a screen and making a fine pattern, these methods involve problems that they cannot realize uniformity in the screen in view of dimensional accuracy and mechanical precision.

SUMMARY OF THE INVENTION

An object of the present invention is to provide a process for producing a phosphor pattern for a field emission display panel in which a phosphor pattern for a field emission display panel can be formed on a substrate such as a substrate for forming a phosphor layer for a field emission display panel on which a conductive layer is formed with good mass productivity, high precision and uniform shape.

Another object of the present invention is to provide a process for preparing a phosphor pattern for a field emission display panel with excellent workability and environmental safety.

Further object of the present invention is to provide a process for producing a phosphor pattern for a field emission display panel which is restrained from decreasing in a film thickness and excellent in photosensitivity.

Still further object of the present invention is to provide a photosensitive element for a field emission display panel which is excellent in restraint of edge fusion and handling property, and can form a phosphor pattern having high precision, uniform shape and excellent photosensitivity with good workability.

Still further object of the present invention is to provide a phosphor pattern for a field emission display panel having high precision, uniform shape and excellent in luminance.

Still further object of the present invention is to provide a field emission display panel provided with a phosphor pattern for a field emission display panel having high precision, uniform shape and excellent in luminance.

The first invention relates to a process for preparing a phosphor pattern for a field emission display panel which comprises the steps of: (I) forming (A) a photosensitive resin composition layer containing a phosphor on a substrate to which a conductive layer is formed; (II) selectively irradiating active light to (A) the photosensitive resin composition layer containing a phosphor (III) selectively removing (A) the photosensitive resin composition layer containing a phosphor to which active light has been selectively irradiated by development to form a pattern; and (IV) calcining the pattern to remove unnecessary portion to form a phosphor pattern.

The second invention relates to a process for preparing a phosphor pattern for a field emission display, wherein the step (I) is (Ia) a step of placing a photosensitive element having (A) a photosensitive resin composition layer containing a phosphor formed on a support film on the substrate to which a conductive layer is formed so as to contact (A) the photosensitive resin composition layer containing a phosphor with the substrate to which a conductive layer is formed and applying a pressure to (A) the photosensitive resin composition layer containing a phosphor to laminate (A) the photosensitive resin composition layer containing a phosphor on the substrate to which a conductive layer is formed.

The third invention relates to a process for preparing a phosphor pattern for a field emission display, wherein the step (I) is (Ib) a step of placing, on a substrate to which a conductive layer is formed, (B) a filling layer on (A) a photosensitive resin composition layer containing a phosphor and in such a state, applying a pressure to (B) the filling layer to laminate (A) the photosensitive resin composition layer containing a phosphor and (B) the filling layer on the substrate to which a conductive layer is formed, and (Ic) a step of removing (B) the filling layer.

The fourth invention relates to a process for preparing a phosphor pattern for a field emission display, wherein the step (I) is (Ib') a step of placing a photosensitive element having (B) a filling layer on a support film and (A) a photosensitive resin composition layer containing a phosphor thereon on the substrate to which a conductive layer is formed so as to contact (A) the photosensitive resin composition layer containing a phosphor with the substrate to which a conductive layer is formed and applying a pressure to (B) the filling layer to laminate (A) the photosensitive resin composition layer containing a phosphor and (B) the filling layer on the substrate to which a conductive layer is formed, and (Ic) a step of removing (B) the filling layer.

The fifth invention relates to a process for preparing a phosphor pattern for a field emission display panel, wherein the respective steps of (I) to (III) are repeated to form a multi-colored pattern comprising photosensitive resin composition layer containing phosphors which are colored to red, green and blue, and then subjecting to the step of (IV) to form a multi-colored phosphor pattern.

The sixth invention relates to a process for preparing a phosphor pattern for a field emission display panel, wherein the respective steps of (I) to (IV) are repeated to form a multi-colored pattern comprising photosensitive resin composition layer containing phosphors which are colored to red, green and blue.

The seventh invention relates to a process for preparing a phosphor pattern for a field emission display panel, wherein (A) said photosensitive resin composition layer containing a phosphor contains:

(a) a polymer having a film-forming property, (b) a photopolymerizable unsaturated compound having an ethylenically unsaturated group, (c) a photoinitiator forming a free radical by irradiation of active light, and (d) a phosphor.

The eighth invention relates to a photosensitive element for a field emission display panel having (A) a photosensitive resin composition layer containing a phosphor on a support film.

The ninth invention relates to a photosensitive element for a field emission display panel, wherein said element has (B) a filling layer on a support film, and (A) a photosensitive resin composition layer containing a phosphor on (B) the filling layer.

The tenth invention relates to a phosphor pattern for a field emission display panel, wherein (A) said photosensitive resin composition layer containing a phosphor contains:

(d) a polymer having a film-forming property, (e) a photopolymerizable unsaturated compound having an ethylenically unsaturated group, (f) a photoinitiator forming a free radical by irradiation of active light, and (d) a phosphor.

The eleventh invention relates to a phosphor pattern for a field emission display panel which is prepared by the above-mentioned processes.

The twelfth invention relates to a field emission display panel which is provided with the phosphor pattern for a field emission display panel.

DESCRIPTION OF THE PREFERRED EMBODIMENTS

In the following, the present invention is explained in detail.

The first invention relates to a process for preparing a phosphor pattern for a field emission display panel which comprises the steps of: (I) forming (A) a photosensitive resin composition layer containing a phosphor on a substrate to which a conductive layer is formed; (II) selectively irradiating active light to (A) the photosensitive resin composition layer containing a phosphor; (III) selectively removing (A) the photosensitive resin composition layer containing a phosphor to which active light has been irradiated by development to form a pattern; and (IV) calcining the pattern to remove unnecessary portion to form a phosphor pattern.

As the substrate to which a conductive layer is formed in the present invention, there may be mentioned, for example, a substrate comprising an inorganic material such as a glass plate, an alumina plate, a ceramics plate, a metal substrate (aluminum, copper, nickel, stainless, etc.) and the like; or a substrate comprising an organic material such as a synthetic resin plate, and the like, as well as a substrate in which a conductive layer comprising a graphite, metal, alloy or metal oxide film is formed, all of which may be subjected to a surface treatment for adhesion.

A conductive layer comprising a metal, alloy or metal oxide (such as aluminum, copper, silver, gold, nickel, chromium, molybdenum, tungsten, platinum, titanium, palladium, ruthenium dioxide, palladium-silver alloy, indium-tin oxide, etc.) is not particularly limited, and can be formed by subjecting a material containing metal or metal oxide to deposition, sputtering, plating, coating, printing, etc.

Such a substrate to which a conductive layer is formed can be used as a substrate for forming a phosphor layer of a field emission display panel.

Figure 1:
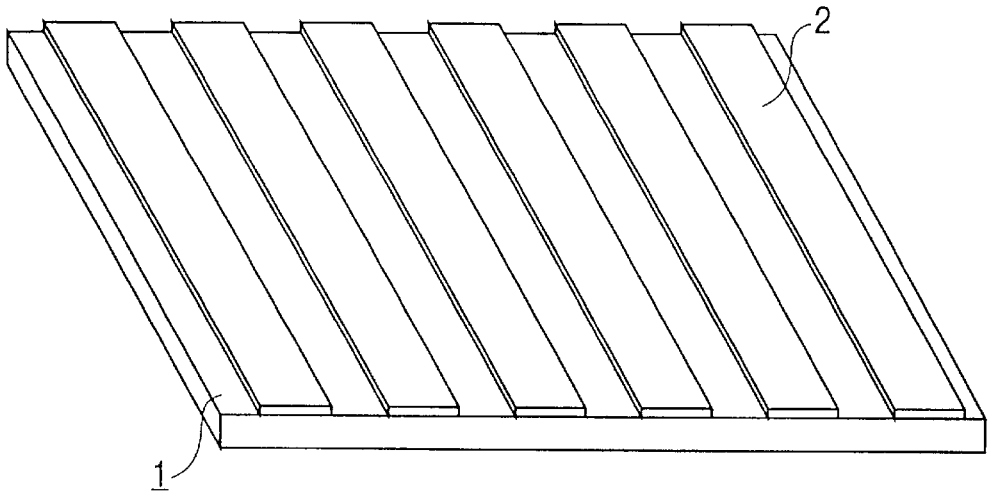
FIG. 1 is a schematic view showing a partial view of one example of a substrate for forming a transmission type FED luminescent layer.
Figure 2:
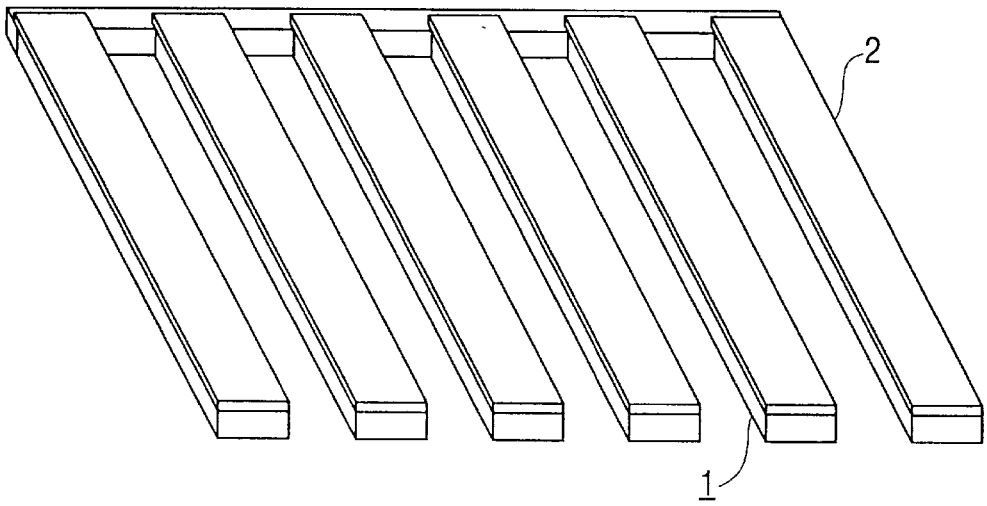
FIG. 2 is a schematic view showing a partial view of one example of a substrate for forming a reflection type FED luminescent layer.

In FIG. 1 and FIG. 2, partial schematic views of examples of substrates for forming a FED phosphor layer.

FIG. 1 is a substrate for forming a phosphor layer to be used as a front plate of a transmission type FED, while FIG. 2 is a substrate for forming a phosphor layer to be used as an intermediate plate of a reflection type FED. In FIG. 1 and FIG. 2, the reference numeral 1 is a substrate for forming a FED phosphor layer, and 2 is a conductive layer.

As (A) the photosensitive resin composition layer containing a phosphor in the present invention, the composition is not particularly limited and can be constituted by a photosensitive resin composition generally used in the photolithographic method. In the present invention, in view of photosensitivity and workability, those containing (a) a polymer having a film-forming property, (b) a photopolymerizable unsaturated compound having an ethylenically unsaturated group, (c) a photoinitiator forming a free radical by irradiation of active light, and (d) a phosphor as described in EP 0 785 565 A1 are preferred.

Also, in (A) the photosensitive resin composition layer containing a phosphor according to the present invention, unnecessary portion is required to be removed by calcination. Thus, among (b) the photopolymerizable unsaturated compounds having an ethylenically unsaturated group at the terminal, it is more preferred to use polyethylene glycol di(meth)acrylate, polypropylene glycol di(meth)acrylate or poly(ethylene-propylene) glycol di(meth)acrylate each of which has a good thermal decomposition property.

Also, when preparing a phosphor pattern mentioned hereinbelow, unnecessary portion shall be removed by calcination. Thus, among the photosensitive resin composition constituting (A) the photosensitive resin composition layer containing a phosphor according to the present invention, the photosensitive resin composition other than (d) a phosphor and a binder is required to have good thermal decomposition property. Therefore, it is preferred that the photosensitive resin composition other than (d) a phosphor and a binder shall not contain elements other than carbon, hydrogen, oxygen and nitrogen as elements constituting the same.

The phosphor (d) used in the present invention is not particularly limited and those mainly comprising metal oxide or metal sulfide can be used.

As a phosphor which emits red light (red phosphor), there may be mentioned, for example, $Y_2O_2S$:Eu, $Zn_3(PO_4)_2$:Mn, $Y_2O_3$:Eu, $YVO_4$:Eu, (Y,Gd)$BO_3$:Eu, γ-$Zn_3(PO_4)_2$:Mn, (Zn, Cd)S:Ag, (Zn,Cd)S:Ag+$In_2O_3$, $Fe_2O_3$ attached $Y_2O_2S$:Eu, etc.

As a phosphor which emits green light (green phosphor), there may be mentioned, for example, ZnS:Cu, $Zn_2SiO_4$:Mn, ZnS:Cu+$Zn_2SiO_4$:Mn, $Gd_2O_2S$:Tb, $Y_3Al_5O_{12}$:Ce, ZnS:Cu,Al, $Y_2O_2S$:Tb, ZnO:Zn, ZnS:Cu,Al+$In_2O_3$, $LaPO_4$:Ce,Tb, BaO·6$Al_2O_3$:Mn, (Zn,Cd)S:Ag, (Zn, Cd)S:Cu,Al, ZnS:Cu,Au,Al, $Y_3(Al,Ga)_2O_{12}$:Tb, $Y_2SiO_5$:Tb, LaOCl:Tb, $GeO_4$:Mn, etc.

As a phosphor which emits blue light (blue phosphor), there may be mentioned, for example, ZnS:Ag, ZnS:Ag,Al, ZnS:Ag,Ga,Al, ZnS:Ag,Cu,Ga,Cl, ZnS:Ag+$In_2O_3$, $Ca_2B_5O_9Cl$:$Eu^{2+}$, $(Sr,Ca,Ba,Mg)_{10}(PO_4)_6Cl_2$:$Eu^{2+}$, $Sr_{10}(PO_4)_6Cl_2$:$Eu^{2+}$, $BaMgAl_{10}O_{17}$:$Eu^{2+}$, $BaMgAl_{14}O_{23}$:$Eu^{2+}$, $BaMgAl_{16}O_{26}$:$Eu^{2+}$, CoO,$Al_2O_3$ attached ZnS:Ag, ZnS:Ag, Ga, etc.

The particle size of (d) the phosphor in the present invention is preferably 0.1 to 20 μm, more preferably 1 to 15 μm, and particularly preferably 2 to 8 μm. If the particle size is less than 0.1 μm, emission efficiency tends to be lowered, while if it exceeds 20 μm, dispersibility tends to be lowered.

The shape of (d) the phosphor of the present invention is preferably spherical, and the surface area is preferably as small as possible.

A formulation amount of the above-mentioned component (a) is preferably 10 to 90 parts by weight, more preferably 20 to 80 parts by weight based on the total weight of the component (a) and the component (b) as 100 parts by weight. If the amount is less than 10 parts by weight, when it is supplied in a roll state as a photosensitive element, the photosensitive resin composition is exuded from the edge portion of the roll (hereinafter referred to this phenomenon as "edge fusion") so that the roll can hardly be dispatched when laminating the photosensitive element, or there is a tendency of lowering in film-forming property. If it exceeds 90 parts by weight, sensitivity tends to be insufficient.

A formulation amount of the above-mentioned component (b) is preferably 10 to 90 parts by weight, more preferably 20 to 80 parts by weight based on the total weight of the component (a) and the component (b) as 100 parts by weight. If the amount is less than 10 parts by weight, sensitivity of the photosensitive resin composition containing a phosphor tend to be insufficient, while if it exceeds 90 parts by weight, the photocured product tends to be brittle, and when a photosensitive element is made, the photosensitive resin composition containing a phosphor is exuded from the edge portion due to its fluidity or a film-forming property tends to be lowered.

A formulation amount of the above-mentioned component (c) is preferably 0.01 to 30 parts by weight, more preferably 0.1 to 20 parts by weight based on the total weight of the component (a) and the component (b) as 100 parts by weight. If the amount is less than 0.01 part by weight, sensitivity of the photosensitive resin composition tend to be insufficient, while if it exceeds 30 parts by weight, absorption of an active light at the exposed surface of the photosensitive resin composition containing a phosphor is increased whereby photocuring at the inner portion tends to be insufficient.

A formulation amount of the above-mentioned component (d) is preferably 10 to 400 parts by weight, more preferably 50 to 350 parts by weight, particularly preferably 70 to 300 parts by weight based on the total weight of the component (a), the component (b) and the component (c) as 100 parts by weight. If the amount is less than 10 parts by weight, when it is emitted, emission efficiency tends to be lowered, while if it exceeds 400 parts by weight, when it is made as a photosensitive element, a film-forming property or flexibility tends to be lowered.

In the photosensitive resin composition constituting (A) the photosensitive resin composition layer containing a phosphor of the present invention, a plasticizer may be added to improve a film-forming property.

As the plasticizer, those generally used in this field of the art may be used, but in view of workability, etc., those described in European Patent No. 0 785 565 are preferably used.

The formulating amount of the plasticizer is preferably 0 to 90 parts by weight, more preferably 0 to 80 parts by weight, particularly preferably 0 to 70 parts by weight based on the total amount of the component (a) and the component (b) as 100 parts by weight. If the amount exceeds 90 parts by weight, sensitivity of the photosensitive resin composition constituting (A) the photosensitive resin composition layer containing a phosphor tends to be insufficient.

To the photosensitive resin composition constituting (A) the photosensitive resin composition layer containing a phosphor of the present invention may be added a compound having a carboxyl group, a dispersant, a binder, a conventionally known dye, pigment, colorant, plasticizer, polymerization inhibitor, surface modifier, stabilizer, adhesiveness imparting agent, heat curing agent, etc. as described in European Patent No. 0 785 565 depending on necessity.

The photosensitive element for a field emission display panel of the present invention comprises (A) the photosensitive resin composition layer containing a phosphor on a support film.

The photosensitive element for a field emission display panel of the present invention preferably comprises on a support film (B) a filling layer and on the filling layer, (A) the photosensitive resin composition layer containing a phosphor is further provided to improve workability, etc.

The photosensitive element for a field emission display panel of the present invention preferably employs the above-mentioned photosensitive resin composition constituting (A) the photosensitive resin composition layer containing a phosphor of the present invention as (A) the photosensitive resin composition layer containing a phosphor in the points of workability and photosensitivity, etc.

The photosensitive element for a field emission display panel of the present invention can be formed by dissolving or mixing the above-mentioned respective components constituting the above-mentioned (A) the photosensitive resin composition layer containing a phosphor in a suitable solvent which can dissolve or disperse the respective components to prepare a uniform solution or dispersion, then coating the solution or the dispersion on a support film and drying the same.

The photosensitive film for a field emission display panel of the present invention can be obtained by dissolving or mixing the above-mentioned resin, etc. constituting (B) the filling layer mentioned below in a suitable solvent to prepare a uniform solution, coating the solution on a support film and drying the same, then, dissolving or mixing the above-mentioned respective components constituting the above-mentioned (A) the photosensitive resin composition layer containing a phosphor in a suitable solvent which can dissolve or disperse the respective components to prepare a solution or uniform dispersion, then coating the solution or the dispersion on (B) the filling layer and drying the same.

As the support film to be used in the present invention, there may be mentioned those which are chemically and thermally stable and constituted by a plastic material, for example, polyethylene terephthalate, polycarbonate, polyethylene and polypropylene, etc., of these, polethylene terephthalate and polyethylene are preferred, and polyethylene terephthalate is more preferred.

Since the support film shall be removable from (A) the photosensitive resin composition layer containing a phosphor at a later stage, it shall not be a film the surface of which is subjected to surface treatment which makes removal impossible or shall not comprise such a material.

The thickness of the support film is preferably 5 to 100 $\mu$m, more preferably 10 to 80 $\mu$m.

As the solvent which can dissolve or disperse the above-mentioned respective components constituting (A) the photosensitive resin composition layer containing a phosphor, there may be mentioned, for example, toluene, acetone, methyl ethyl ketone, methyl isobutyl ketone, ethylene glycol monomethyl ether, ethylene glycol monoethyl ether, $\gamma$-butyrolactone, N-methylpyrrolidone, dimethylformamide, tetramethylsulfone, diethylene glycol dimethyl ether, diethylene glycol monobutyl ether, chloroform, methylene chloride, methyl alcohol, ethyl alcohol, etc. These may be used singly or in combination of two or more.

As the coating method, any methods conventionally known in the art may be used, and there may be mentioned, for example, the knife coating method, the roll coating method, the spray coating method, the gravure coating method, the bar coating method, and the curtain coating method, etc.

The drying temperature is preferably 60 to 130° C. and the drying time is 3 minutes to one hour.

The thickness of (A) the photosensitive resin composition layer containing a phosphor of the photosensitive element for a field emission display panel of the present invention is not particularly limited, and preferably made 5 to 200 $\mu$m, more preferably 8 to 120 $\mu$m, particularly preferably 10 to 80 $\mu$m. If the thickness is less than 5 $\mu$m, a phosphor pattern after calcination mentioned below becomes thin and emission efficiency tends to be lowered, while if it exceeds 200 $\mu$m, the shape of the phosphor pattern tends to be bad.

(A) the photosensitive resin composition layer containing a phosphor of the photosensitive element for a field emission display panel of the present invention preferably has a viscosity at 100° C. of 1 to $1\times10^9$ Pa·sec, more preferably 2 to $1\times10^8$ Pa·sec, particularly preferably 5 to $1\times10^7$ Pa·sec, most preferably 10 to $1\times10^6$ Pa·sec. If the viscosity at 100° C. is less than 1 Pa·sec, the viscosity at room temperature becomes too low and when a photosensitive element is made by using the composition, (A) the photosensitive resin composition layer containing a phosphor tends to be exuded from an edge portion whereby a film forming property tends to be lowered. If it exceeds $1\times10^9$ Pa·sec, adhesive properties of (A) the photosensitive resin composition layer containing a phosphor to the substrate to which a conductive layer tends to be lowered.

As sensitivity of (A) the photosensitive resin composition layer containing a phosphor of the present invention, when active light is selectively irradiated with a predetermined dose of active light by using 21 grades step tablet (available from Hitachi Chemical Co., Ltd.), etc. in the step of selectively irradiating active light mentioned hereinbelow, and development is carried out by the step of removing unnecessary portion by development mentioned hereinbelow, the step number of the remaining step tablet of (A) the photosensitive resin composition layer containing a phosphor is preferably 1 to 21 grades, more preferably 1.5 to 18 grades, particularly preferably 2 to 15 grades.

As resolution of (A) the photosensitive resin composition layer containing a phosphor of the present invention, when active light is selectively irradiated with a predetermined dose of active light by using a photomask for evaluating resolution (available from Hitachi Chemical Co., Ltd.), etc., and development is carried out by the step of removing unnecessary portion by development mentioned hereinbelow, the minimum line/space of the remaining (A) the photosensitive resin composition layer containing a phosphor is preferably 1 mm/1 mm or less, more preferably 900 $\mu$m/900 $\mu$m or less, particularly preferably 800 $\mu$m/800 $\mu$m or less.

As adhesive properties of (A) the photosensitive resin composition layer containing a phosphor of the present invention, when active light is selectively irradiated with a predetermined dose of active light by using a photomask for evaluating adhesiveness (available from Hitachi Chemical Co., Ltd.), etc., and development is carried out by the step of removing unnecessary portion by development mentioned hereinbelow, the minimum line/space of the remaining (A) the photosensitive resin composition layer containing a phosphor is preferably 400 $\mu$m/400 $\mu$m or less, more preferably 350 $\mu$m/400 $\mu$m or less, particularly preferably 300 $\mu$m/400 $\mu$m or less.

On (A) the photosensitive resin composition layer containing a phosphor of the photosensitive element for a field emission display panel of the present invention, a removable cover film may be laminated.

As a material for the cover film, there may be mentioned, for example, polyethylene, polypropylene, polyethylene terephthalate, polycarbonate, etc. Preferred materials are those which have an adhesive force to (A) the photosensitive resin composition layer containing a phosphor smaller than an adhesive force between the support film and (A) the photosensitive resin composition layer containing a phosphor.

The film thickness of the cover film is not particularly limited, but preferably 5 to 100 μm, more preferably 10 to 90 μm.

The thus prepared photosensitive element for a field emission display panel of the present invention can be stored by wounding in a roll state.

As a material for constituting (B) the filling layer in the photosensitive element for a field emission display panel of the present invention, it is not particularly limited so long as a resin having thermoplastic properties which deforms by a stress from outside, and there may be mentioned, for example, a film-forming property imparting polymer, polyethylene, polypropylene, polyvinyl chloride, polyvinyl acetate, polyvinylidene chloride, polystyrene, polyvinyltoluene, polyacrylic acid ester, polymethacrylic acid ester, a copolymer of ethylene and vinyl acetate, a copolymer of ethylene and acrylic acid ester, a copolymer of vinyl chloride and vinyl acetate, a copolymer of styrene and acrylic acid ester or methacrylic acid ester, a copolymer of vinyl toluene and acrylic acid ester or methacrylic acid ester, a polyvinyl alcohol type resin (a hydrolyzed product of polyvinyl acetate, a hydrolyzed product of a copolymer of ethylene and vinyl acetate, a hydrolyzed product of a copolymer of vinyl chloride and vinyl acetate, etc.), a water-soluble salt of carboxyalkyl cellulose, a water-soluble cellulose ether, polyvinyl-pyrrolidone, a rein having a carboxyl group obtained by copolymerizing an unsaturated carboxylic acid and an unsaturated monomer copolymerizable therewith, and the like.

In (B) the filling layer in the photosensitive element for a field emission display panel of the present invention, in view of restraining migration to (B) the filling layer, it may be optionally added thereto the above-mentioned (b) a photopolymerizable unsaturated compound having an ethylenically unsaturated group, (c) a photoinitiator forming a free radical by irradiation of active light, a compound having a carboxyl group, a dye, a coloring agent, a plasticizer, a polymerization inhibitor, a surface modifier, a stabilizer, an adhesive property imparting agent, a heat curing agent, etc. depending on necessity. As these materials, those which can be used in the photosensitive resin composition constituting (A) the photosensitive resin composition layer containing a phosphor may be used.

Among the materials as mentioned above, for example, as for polyethylene, polypropylene, Teflon, etc. may be used as (B) the filling layer by molding to a film state using the melt extrusion method, etc. With regard to the resins other than those as mentioned above, a material such as a resin is dissolved in a solvent which can dissolve the material uniformly and the solution is coated on a support film and dried to obtain (B) the filling layer.

As the solvent which can dissolve the above-mentioned resin, etc. constituting (B) the filling layer in the photosensitive element for a field emission display panel of the present invention, there may be mentioned, for example, water, toluene, acetone, methyl ethyl ketone, methyl isobutyl ketone, ethylene glycol monomethyl ether, ethylene glycol monoethyl ether, γ-butyrolactone, N-methylpyrrolidone, dimethylformamide, tetramethylsulfone, diethylene glycol dimethyl ether, diethylene glycol monobutyl ether, chloroform, methylene chloride, methyl alcohol, ethyl alcohol, etc. These may be used singly or in combination of two or more.

As the coating method, any methods conventionally known in the art may be used, and there may be mentioned, for example, the knife coating method, the roll coating method, the spray coating method, the gravure coating method, the bar coating method, and the curtain coating method, etc.

The drying temperature is preferably 60 to 130° C. and the drying time is 3 minutes to one hour.

The thickness of (B) the filling layer in the photosensitive element for a field emission display panel of the present invention is not particularly limited, and in view of patterning properties of three colors of phosphor layers of R, G and B on the substrate for forming the FED phosphor layer, it is preferably made 10 to 200 μm, more preferably 20 to 100 μm.

(B) the filling layer in the photosensitive element for a field emission display panel of the present invention preferably has a viscosity at 100° C. of 1 to $1\times10^9$ Pa·sec, more preferably 2 to $1\times10^8$ Pa·sec, particularly preferably 5 to $1\times10^7$ Pa·sec, most preferably 10 to $1\times10^6$ Pa·sec. If the viscosity at 100° C. is less than 1 Pa·sec, the viscosity at room temperature becomes too low and when a film is made by using the composition, (B) the filling layer tends to be exuded from an edge portion whereby a film forming property tends to be lowered. If it exceeds $1\times10^9$ Pa·sec, three colors of phosphor layers of R, G and B of (A) the photosensitive resin composition layer containing a phosphor tends to be not uniformly formed.

After forming (B) the filling layer on the support film, by forming (A) the photosensitive resin composition layer containing a phosphor as mentioned above thereon, a photosensitive element for a field emission display panel of the present invention can be obtained.

On (B) the filling layer of the photosensitive element for a field emission display panel of the present invention having (A) the photosensitive resin composition layer containing a phosphor and (B) the filling layer, a removable cover film may be laminated.

As a material for the cover film, there may be mentioned, for example, polyethylene, polypropylene, polyethylene terephthalate, polycarbonate, etc. Preferred materials are those which have an adhesive force to (B) the filling layer smaller than an adhesive force between (A) the photosensitive resin composition layer containing a phosphor and (B) the filling layer.

(B) the filling layer of the present invention may be a laminated structure of the above mentioned materials of components which can be used in the invention.

The thus prepared photosensitive element for a field emission display panel of the present invention having (A) the photosensitive resin composition layer containing a phosphor and (B) the filling layer in a film state can be stored by wounding in a roll state.

(B) the filling layer in the present invention must be finally removed from (A) the photosensitive resin composition layer containing a phosphor. Thus, it is preferred to optionally and previously select a material which is capable of removing from (A) the photosensitive resin composition layer containing a phosphor.

In the film having (A) the photosensitive resin composition layer containing a phosphor and (B) the filling layer in the present invention, in view of workability, (A) the photosensitive resin composition layer containing a phosphor preferably comprises a support film, (A) the photosensitive resin composition layer containing a phosphor and a cover film, and (B) the filling layer preferably comprises a support film, (B) the filling layer and a cover film.

Also, in the step of removing (B) the filling layer mentioned bereinbelow, in order to improve peeling property of (B) the filling layer, between (B) the filling layer and the cover film, a film for easily separating the layer (B) and the layer (A), which has a small adhesive force with (A) the photosensitive resin composition layer containing a phosphor and the cover film than that with (B) the filling layer may be provided.

In the following, one example of the process for preparing a phosphor pattern for a field emission display panel of the present invention will be explained by referring to the respective steps of FIGS. 3(I)–3(VII) when a substrate for preparing a phosphor layer to be used as a transmittance type FED front panel to which a conductive layer and a black matrix are formed. Incidentally, FIGS. 3(I)–3(IV) is a schematic view showing respective steps of one example of the process for preparing a phosphor pattern for a field emission display panel of the present invention.

(I) Step of forming (A) photosensitive resin composition layer containing a phosphor on a substrate to which a conductive layer is formed In the step of (I), (A) the photosensitive resin composition layer containing a phosphor is formed on the substrate to which the conductive layer and the black matrix are formed.

As the method for preparing (A) the photosensitive resin composition layer containing a phosphor, there may be mentioned, for example, a method wherein a solution of the photosensitive resin composition constituting (A) the photosensitive resin composition layer containing a phosphor is coated by using a conventionally known method to form a photosensitive resin composition layer, a method wherein the photosensitive elements for a field emission display panel of the present invention as mentioned above are used and they are laminated to form a photosensitive resin composition layer, and the like.

In view of workability, environmental safety, film-forming property of the photosensitive resin layer to a large-sized surface substrate, it is preferred to use the method wherein the photosensitive elements for a field emission display panel of the present invention as mentioned above are used and they are laminated to form a photosensitive resin composition layer.

As the coating method in the method wherein a solution of the photosensitive resin composition is coated by using a conventionally known method to form a photosensitive resin composition layer, there may be mentioned, for example, a roll coating method, a spray coating method, an electrodeposition method, a curtain coating method, or the like. Of these, in the case of a substrate with a large-sized surface, a curtain coating method is preferably used since a photosensitive resin composition layer can be uniformly formed with simply and easily.

As a process for forming (A) the photosensitive resin composition layer containing a phosphor by using the photosensitive elements for a field emission display panel of the present invention, there may be mentioned, for example, (i) (Ia) a process of placing a photosensitive element having (A) a photosensitive resin composition layer containing a phosphor formed on a support film on the substrate to which a conductive layer is formed so as to contact (A) the photosensitive resin composition layer containing a phosphor with the substrate to which a conductive layer is formed and applying a pressure to (A) the photosensitive resin composition layer containing a phosphor to laminate (A) the photosensitive resin composition layer containing a phosphor on the substrate to which a conductive layer is formed;

(ii) (Ib) a process which comprises the steps of placing, on a substrate to which a conductive layer is formed, (B) a filling layer on (A) a photosensitive resin composition layer containing a phosphor and in such a state, applying a pressure to (B) the filling layer to laminate (A) the photosensitive resin composition layer containing a phosphor and (B) the filling layer on the substrate to which a conductive layer is formed, and (Ic) a step of removing (B) the filling layer;

(iii) (Ib') a process which comprises the steps of placing a photosensitive element having (B) a filling layer on a support film and (A) a photosensitive resin composition layer containing a phosphor thereon on the substrate to which a conductive layer is formed so as to contact (A) the photosensitive resin composition layer containing a phosphor with the substrate to which a conductive layer is formed and applying a pressure to (B) the filling layer to laminate (A) the photosensitive resin composition layer containing a phosphor and (B) the filling layer on the substrate to which a conductive layer is formed, and (Ic) a step of removing (B) the filling layer.

In the following, processes for laminating (A) the photosensitive resin composition layer containing a phosphor by using the processes (ii) and (iii) will be explained in more detail.

Figure 3I:
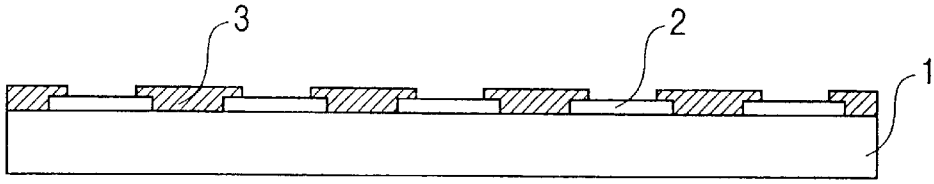
FIGS. 3(I)–3(VII) are schematic views showing one example of respective steps in a process for preparing a phosphor pattern for a field emission display panel of the present invention.
Figure 3:
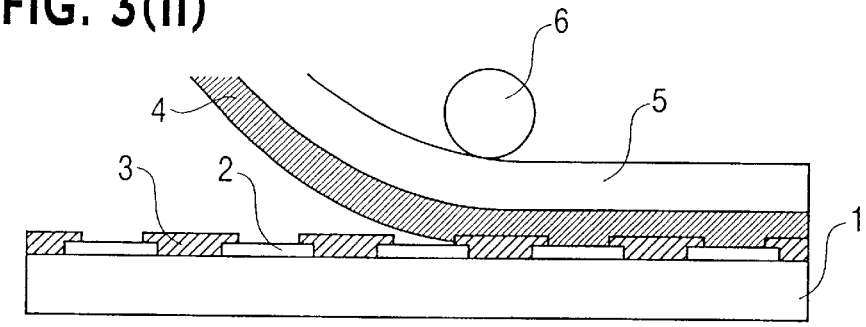
Figure 3:
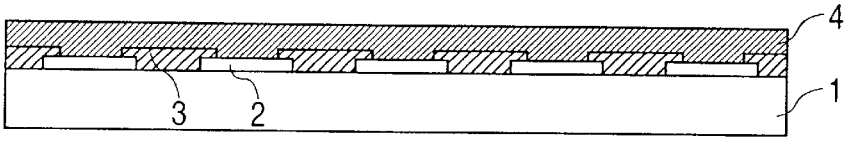

A substrate for forming a FED phosphor layer to which a conductive layer 2 and a black matrix are formed is shown in FIG. 3(I), and a state of forming (A) a photosensitive resin composition layer containing a phosphor and (B) a filling layer on the substrate for forming a FED phosphor layer in which pressure is applied to (B) the filling layer in the state of providing (A) the photosensitive resin composition layer containing a phosphor and (B) the filling layer on the substrate is shown in FIG. 3(II).

In FIG. 3(I) and FIG. 3(II), the reference numeral 3 is a black matrix, 4 is (A) a photosensitive resin composition layer containing a phosphor, 5 is (B) a filling layer and 6 is a pressing roller.

In FIG. 3(II), as a method for forming (A) the photosensitive resin composition layer 4 containing a phosphor on the substrate 1 for forming a FED phosphor layer, there may be mentioned, for example, a method of laminating with the use of the above-mentioned photosensitive element having the support film, (B) the filling layer and (A) the photosensitive resin composition layer containing a phosphor, and the like.

When lamination is carried out by using the photosensitive element and a cover film is present in the photosensitive element, after removing the cover film, (B) the filling layer 5 is provided at the upper side of (A) the photosensitive resin composition layer 4 containing a phosphor so as to contact (A) the photosensitive resin composition layer 4 containing a phosphor with the surface of the substrate 1 for forming a FED phosphor layer to which the conductive layer 2 is formed, then (B) the filling layer 5 is pressed to laminate (A) the photosensitive resin composition layer 4 containing a phosphor and (B) the filling layer 5 to the substrate 1 for forming a FED phosphor layer.

In FIG. 3(II), as the method for pressing by providing (B) the filling layer 5 at the upper portion of (A) the photosensitive resin composition layer 4 containing a phosphor, there may be mentioned, for example, the method in which (B) the filling layer 5 (when a cover film is present, after removing the cover film) is provided at the upper portion of (A) the photosensitive resin composition layer 4 containing a phosphor and then pressing the same with a pressing roller 6, etc., and the like.

Also, in order to form three colors of phosphor layers of R, G and B of (A) the photosensitive resin composition layer 4 containing a phosphor more uniformly, when a support film is present on (B) the filling layer 5, pressing may be carried out by a pressing roller 6, etc. while removing the support film depending on necessity.

The bonding pressure at this time is preferably $2.4\times10^2$ to $2.4\times10^5$ N/m, more preferably $4.8\times10^2$ to $1.2\times10^5$ N/m, particularly preferably $9.6\times10^2$ to $2.4\times10^4$ N/m in a linear pressure. If the linear pressure is less than $2.4\times10^2$ N/m, three colors of phosphor layers of R, G and B of (A) the photosensitive resin composition layer 4 containing a phosphor cannot be formed uniformly, while if it exceeds $2.4\times10^5$ N/m, the substrate 1 for forming a FED phosphor layer tends to be broken.

Here, as the method for making the linear pressure $5\times10^3$ N/m, there may be mentioned, for example, a method in which the linear pressure is made $5\times10^3$ N/m by making a cylinder pressure (normal pressure of 1 atom is 0) of a laminating machine 2 kgf/cm$^2$ using a laminating machine having a cylinder diameter of 40 mmϕ and a substrate with a size of 3 mm in thickness, 10 cm in width and 10 cm in length (square), a method in which the linear pressure is made $5\times10^3$ N/m by making a cylinder pressure (normal pressure of 1 atom is 0) of a laminating machine 4 kgf/cm$^2$ using a laminating machine having a cylinder diameter of 40 mmϕ and a substrate with a size of 3 mm in thickness, 20 cm in width and 20 cm in length (square), and the like.

In order to further improve formation of three colors of phosphor layers of R, G and B of (A) the photosensitive resin composition layer 4 containing a phosphor more uniformly, lamination may be carried out by pressing (B) the filling layer 5 while heating by a heating roller, etc., to the surface of the substrate 1 for forming a FED phosphor wherein the conductive layer 2 is formed.

The heating temperature when heating is carried out is preferably 10 to 140° C., more preferably 20 to 135° C., particularly preferably 30 to 130° C. If the heating temperature is less than 10° C., three colors of phosphor layers of R, G and B of (A) the photosensitive resin composition layer 4 containing a phosphor cannot be formed uniformly, while if it exceeds 140° C., (A) the photosensitive resin composition layer 4 containing a phosphor tends to be heat-cured.

When (B) the filling layer 5 is heated as mentioned above, it is not necessary to carry out preheating of the substrate 1 for forming a FED phosphor layer, but in order to further improve formation of three colors of phosphor layers of R, G and B of (A) the photosensitive resin composition layer 4 containing a phosphor more uniformly, a heat-pressure roller the surface of which is made of a material enriched in flexibility such as rubber, plastics, etc. may be used.

The thickness of the layer of the material enriched in flexibility is preferably made 200 to 400 μm.

Further, with the same reason as mentioned above, the above-mentioned pressure and heat-pressure may be carried out under a reduced pressure of $5\times10^4$ Pa or less.

Also, after completion of the lamination, heating may be carried out within the range of 30 to 150° C. for 1 to 120 minutes. At this time, when a support film is present on (B) the filling layer 5, the support film may be removed depending on necessity.

As described above, (A) the photosensitive resin composition layer 4 containing a phosphor can be formed uniformly on the substrate 1 for forming a FED phosphor layer.

In FIG. 3(II), (A) the photosensitive resin composition layer 4 containing a phosphor and (B) the filling layer 5 may be separately laminated by each pressing to the substrate 1 under heating.

As the heat-pressure conditions when the two layers are separately pressed under heating, the conditions where the above-mentioned conditions for heat pressing the two layers simultaneously can be used.

The state in which (A) the photosensitive resin composition layer 4 containing a phosphor and (B) the filling layer 5 are laminated as mentioned above is shown in FIG. 3(III).

Next, the state where (B) the filling layer 5 is removed from the state of FIG. 3(III) is shown in FIG. 3(IV).

When removing (B) the filling layer 5, in order to easily remove (B) the filling layer 5, the substrate 1 for forming a FED phosphor layer may be cooled (generally in the range of −50 to 50° C.) in the state of FIG. 3(III).

As the method for removing (B) the filling layer 5, there may be mentioned, for example, a method of physically peeling off (B) the filling layer 5 by bonding an adhesive tape or using a tool with a hook shape, etc., and the like.

In order to improve workability, a method of peeling off (B) the filling layer 5 by utilizing a power of static electricity, suction, etc.

Immediately after peeling (B) the filling layer 5, (B) the filling layer 5 can be wound by using a wind-up roller, etc.

Figure 3V:
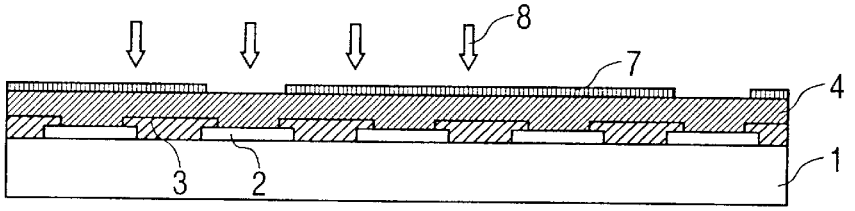
Figure 3:
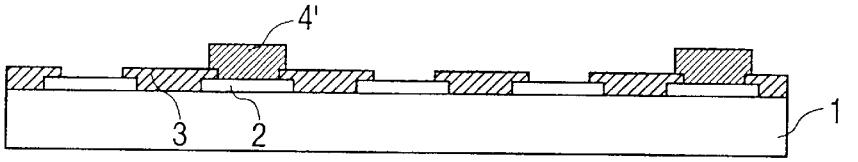

(II) Step of irradiating active light selectively to (A) photosensitive resin composition layer containing a phosphor The state of selectively irradiating active light to (A) the photosensitive resin composition layer 4 containing a phosphor is shown in FIG. 3(V). In FIG. 3(V), the reference numeral 7 is a photomask and 8 is active light.

In FIG. 3(V), as the method of selectively irradiating active light 8, there may be mentioned a method in which active light 8 is selectively irradiated to the upper portion of (A) the photosensitive resin composition layer 4 containing a phosphor in the state of FIG. 3(IV) through a photomask 7 such as a negative film, a positive film, etc., and the like.

At this time, on (A) the photosensitive resin composition layer 4 containing a phosphor, the above-mentioned support film is newly covered and active light 8 may be selectively irradiated.

When (B) the filling layer 5 comprises a material which transmit the active light 8, the present step is carried out in the state that (B) the filling layer 5 is provided and then the above-mentioned step of removing (B) the filling layer may be carried out.

As the active light 8, known active light source may be used, and there may be mentioned, for example, light generated from carbon arc, mercury vapor arc, xenon arc, and others.

The sensitivity of the photoinitiator is generally the maximum at the ultraviolet ray region so that the active light source at that case shall be those which irradiate the ultraviolet ray effectively. When the photoinitiator is sensitive to visible light such as 9,10-phenanthrene-quinone, etc., as the active light 8, a visible light is used. As the light source, in addition to the above-mentioned light sources, flood bulb for photography, solar lamp, etc., may be used.

As the active light 8 in the present invention, there may be mentioned parallel light, scattered light, etc., and either of the parallel light or the scattered light may be used, the both may be used in one step, or else, the both may be used separately with two steps. When both of them are used separately with two steps, either one may be used firstly.

A dose of the active light 9 in the present invention is not particularly limited, but in view of photocurability, it is preferably made 5 to 10000 mJ/cm$^2$, more preferably 7 to 5000 mJ/cm$^2$, particularly preferably 10 to 1000 mJ/cm$^2$.

(III) Step of forming pattern by selectively removing (A) the photosensitive resin composition layer containing a phosphor to which active light is selectively irradiated by development The state in which unnecessary portion is removed by development is shown in FIG. 3(VI). In FIG. 3(VI), the reference numeral 4' is a photosensitive resin layer containing a phosphor after photocuring.

In FIG. 3(VI), as the method of development, for example, when the support film and (B) the filling layer 5 are present on (A) the photosensitive resin composition layer 4 containing a phosphor after selectively irradiating the active light 8, there may be mentioned a method in which, after removing these layers, development is carried out by the conventionally known method such as spraying, dipping under rocking, brushing, scrapping, etc. by using a known developer such as an alkali aqueous solution, an aqueous developer, an organic solvent, etc., to remove the unnecessary portion.

As the method of removing the unnecessary portion of (A) the photosensitive resin composition layer 4 containing a phosphor, dry development in which by utilizing the difference in adhesive properties between the exposed portion and the unexposed portion, only the unnecessary portion having adhesiveness of (A) the photosensitive resin composition layer 4 containing a phosphor is peeled off may be carried out.

As a base for the alkali aqueous solution, there may be mentioned alkali hydroxide (hydroxide of lithium, sodium or potassium, etc.), alkali carbonate (carbonate or bicarbonate of lithium, sodium or potassium, etc.), alkali metal phosphoric acid salt (potassium phosphate, sodium phosphate, etc.), alkali metal pyrophosphoric acid salt (sodium pyrophosphate, potassium pyrophosphate, etc.), tetramethyl ammonium hydroxide, triethanolamine, etc., and of these, sodium carbonate, tetramethyl ammonium hydroxide, etc., may be mentioned as preferred bases.

A pH of the alkali aqueous solution to be used for development is preferably 9 to 11, and the temperature thereof can be adjusted in comply with the developability of (A) the photosensitive resin composition layer 4 containing a phosphor.

In the alkali aqueous solution, a surfactant, an anti-foaming agent, a small amount of an organic solvent for promoting development may be mixed.

As the aqueous developer, there may be mentioned a developer comprising water or the alkali aqueous solution and at least one of an organic solvent.

Here, as a base of the alkali aqueous solution, in addition to the above-mentioned substances, there may be mentioned, for example, borax, sodium metasilicate, ethanolamine, ethylenediamine, diethylenetriamine, 2-amino-2-hydroxymethyl-1,3-propanediaol, 1,3-diamino-propanol-2-morpholine, tetramethyl ammonium hydroxide, etc.

A pH of the aqueous developer is preferably 8 to 12, more preferably 9 to 10.

In the aqueous developer comprising water and at least one kind of an organic solvent (when the organic solvent is not dissolved in water, it is an emulsion solution), as the organic solvent, there may be mentioned, for example, acetone alcohol, acetone, ethyl acetate, alkoxyethanol having an alkoxy group with 1 to 4 carbon atoms, ethyl alcohol, isopropyl alcohol, butyl alcohol, diethylene glycol monomethyl ether, diethylene glycol monoethyl ether, diethylene glycol monobutyl ether, triethylene glycol monobutyl ether, dipropylene glycol monomethyl ether, dipropylene glycol monopropyl ether, 3-methyl-3-methoxybutyl acetate, 1,1,1-trichloroethane, N-methyl-pyrrolidone, N,N-dimethylformamide, cyclohexanone, methyl isobutyl ketone, γ-butyrolactone, etc. These may be used singly or in combination of two or more.

The concentration of the organic solvent is generally within the range of 2 to 90% by weight, and the temperature can be adjusted depending on the developability thereof.

In the aqueous developer, a small amount of a surfactant, an anti-foaming agent may be mixed.

As the organic solvent developer which is used alone, there may be mentioned, for example, 1,1,1-trichloroethane, N-methylpyrrolidone, N,N-dimethylformamide, cyclohexanone, methyl isobutyl ketone, γ-butyrolactone, etc. To these organic solvent, water may be added within the range of 1 to 20% by weight in order to prevent from flaming.

In the conventionally known developer such as water, alkali aqueous solution, aqueous developer (those which comprise water and at least one kind of an organic solvent or the alkali aqueous solution and at least one kind of an organic solvent), organic solvent, etc., it is preferred to not contain a metal ion other than the alkali metal ion nor a halogen ion in the point of preventing from deterioration of the phosphor at development.

Also, after the development, in order to prevent from deterioration of the phosphor, the alkali metal ions remained in the photosensitive resin composition layer 4' containing a phosphor after photocuring can be treated (neutralizing treatment) by the conventionally known method such as spraying, dipping under rocking, brushing, scrapping, etc., by using a Lewis acid or a solution thereof.

After the neutralization treatment, a step of washing with water may be carried out.

After the development, in order to improve adhesiveness and chemical resistance, etc. of the photoresist containing a phosphor on the surface of the substrate for forming a phosphor layer, irradiation by ultraviolet ray due to a high pressure mercury lamp, etc., and heating may be carried out.

A dose of irradiating the ultraviolet ray at this time is generally 0.2 to 10 J/cm$^2$, and heating may be also carried out at the time of the irradiation.

The temperature at the time of heating is preferably 60 to 180° C., more preferably 100 to 180° C. The heating time is preferably 15 to 90 minutes.

Irradiation of the ultraviolet ray and heating may be carried out separately and either of which may be carried out firstly.

(IV) Step of forming phosphor pattern by removing unnecessary portion from the above-mentioned phosphor pattern by calcination The state of forming phosphor pattern after removing unnecessary portion by calcination is shown in FIG. 3(VII). In FIG. 3(VII), the reference numeral 9 is a phosphor pattern.

In FIG. 3(VII), the calcination method is not particularly limited, and by using the conventionally known calcination method, unnecessary portions other than the phosphor and the binder are removed to form a phosphor pattern.

The calcination temperature at this time is preferably 350 to 800° C., more preferably 400 to 600° C. The calcination time is preferably 3 to 120 minutes, more preferably 5 to 90 minutes.

The temperature raising rate at this time is preferably 0.5 to 50° C./min, more preferably 1 to 45° C./min. Also, during 350 to 450° C. before reaching to the maximum temperature, a step of retaining the temperature may be provided, and the retaining time thereof is preferably 5 to 100 minutes.

The calcination may be carried out under air atmosphere, under nitrogen atmosphere, or under air atmosphere and nitrogen atmosphere in combination. Also, during the temperature raising procedure, air atmosphere and nitrogen atmosphere may be optionally used alternately.

In the process for preparing the phosphor pattern for a field emission display panel of the present invention, in the point of reducing the steps or the like, it is preferred that the above-mentioned respective steps (I) to (III) are repeated for each color to form a multi-colored pattern comprising the photosensitive resin composition layers containing phosphors which form colors of red, green and blue, and then the step (IV) is performed to form a multi-colored phosphor pattern.

In the present invention, (A) the photosensitive resin composition layer 4 containing a phosphor which independently contains respective phosphors which form colors of red, blue and green can be formed in any order with regard to the respective colors of red, blue and green.

Figure 4I:
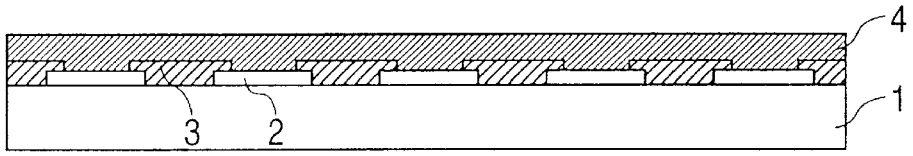
FIGS. 4(I)–4(VI) are schematic views showing one example of a step for forming a multi-colored pattern of the present invention.
Figure 4:
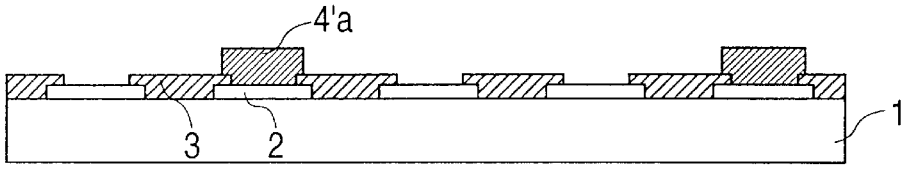
Figure 4:
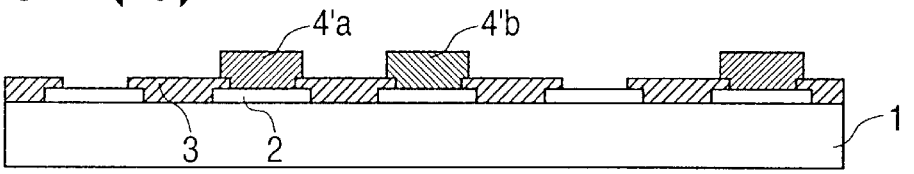
Figure 4V:
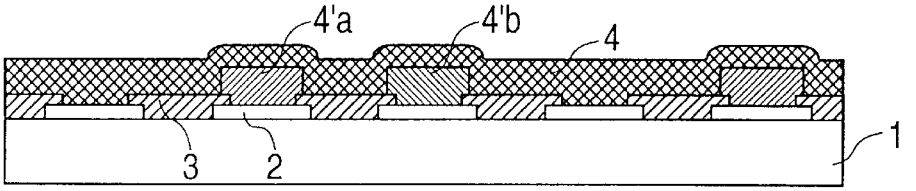
Figure 4:
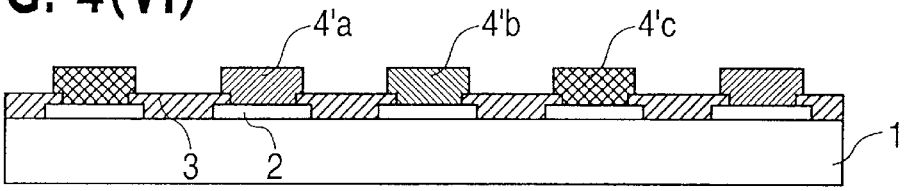

In FIGS. 4(I)–4(VI), the state in which a multi-colored pattern containing the photosensitive resin composition layer containing a phosphor which forms colors of red, green and blue is formed by repeating the respective steps of (I) to (III) for each color is shown. In FIGS. 4(I)–4(VI), the reference numeral 4'*a* is a first color pattern, 4'*b* is a second color pattern, and 4'*c* is a third color pattern.

Figure 5:
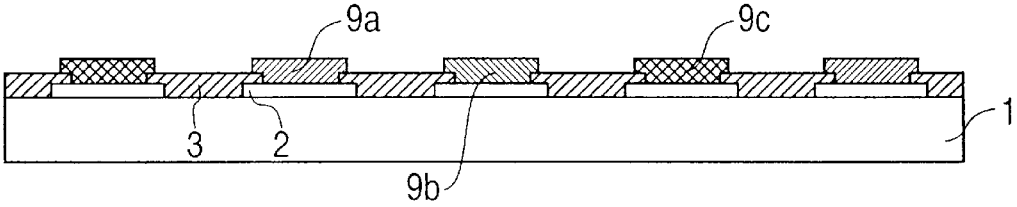
FIG. 5 is a schematic view showing the state in which a multi-colored pattern of the present invention is formed.

In FIG. 5, the state in which the step (IV) of the present invention is performed to form a multi-colored phosphor pattern is shown. In FIG. 5, the reference numeral 9*a* is a first phosphor pattern, 9*b* is a second phosphor pattern, and 9*c* is a third phosphor pattern.

Also, the process for preparing the phosphor pattern for a field emission display panel of the present invention is preferably carried out by repeating the respective steps (I) to (IV) as mentioned above for each color to form a multi-colored phosphor pattern in view of suppression of decrease in film thickness of (A) the photosensitive resin composition layer 5 containing a phosphor to form a multi-colored phosphor pattern which colors to red, green and blue.

The phosphor pattern for a field emission display panel of the present invention can be formed by the producing process as mentioned above, and by the phosphor pattern for a field emission display panel, a field emission display panel having high precision and excellent in brightness can be obtained.

The field emission display panel of the present invention comprises the above-mentioned phosphor pattern for a field emission display panel of the present invention on the substrate for forming a FED phosphor layer.

Figure 6:
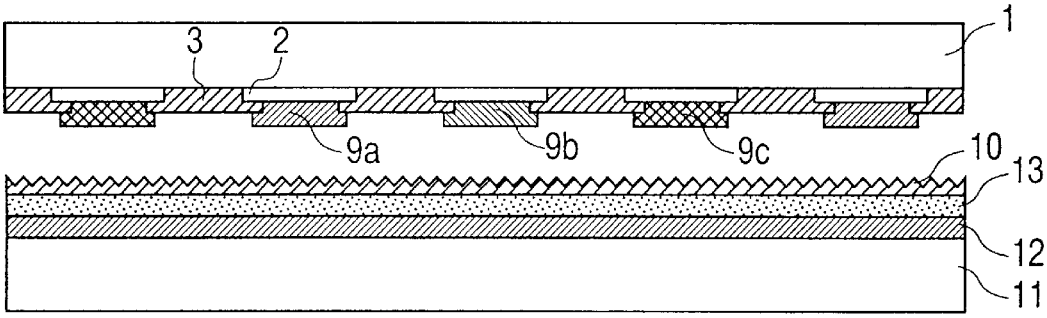
FIG. 6 is a schematic view showing sectional view of one example of a transmission type FED.

In the following, the field emission display panel of the present invention is explained by referring to FIG. 6 and FIG. 7. FIG. 6 is a schematic view showing a sectional view of one example of a transmission type FED, and FIG. 7 is a schematic view showing a sectional view of one example of a reflection type FED.

Figure 7:
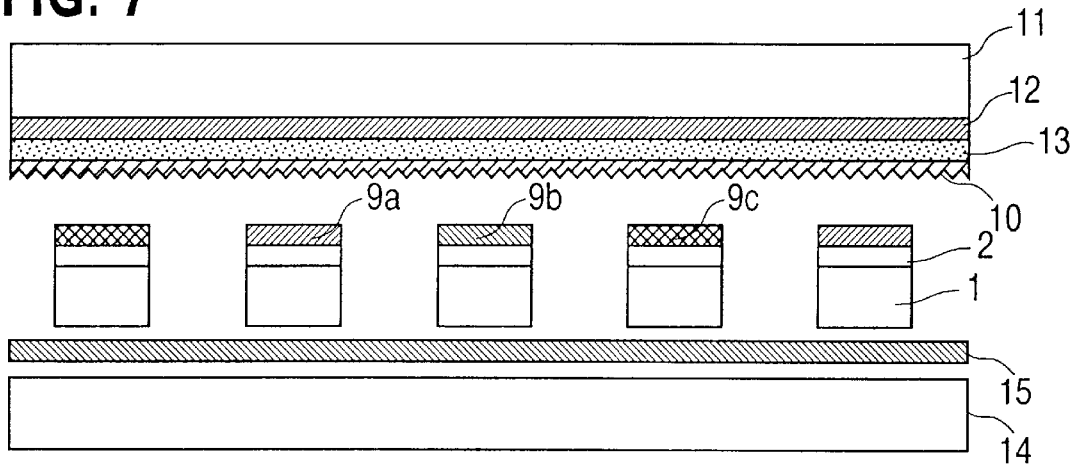
FIG. 7 is a schematic view showing sectional view of one example of a reflection type FED.

In FIG. 6 and FIG. 7, the reference numeral 10 is an emitter cold cathode, 11 is a glass substrate, 12 is a cathode, 13 is a resistance film, 14 is a back surface substrate, and 15 is a target sheet.

The process for producing the phosphor pattern for a field emission display panel, the photosensitive element for a field emission display panel and the phosphor pattern for a field emission display panel of the present invention can be also applied to the process for producing the phosphor pattern of a spontaneous emission display such as a CRT display panel and an electro-luminescence display panel (ELD), etc.

EXAMPLES

In the following, the present invention is explained by referring to Examples.

Preparation Example 1

(Preparation of a polymer solution having film property)

In a flask equipped with a stirrer, a reflux condenser, an inert gas inlet tube and a thermometer was charged "P" shown in Table 1, and the temperature of the solvent was raised to 80° C. under nitrogen atmosphere, and while maintaining the reaction temperature at 80° C.±2° C., a mixed solution "Q" of a material shown in Table 1 was uniformly added dropwise over 4 hours.

After dropwise addition, stirring was continued at 80° C.±2° C. for 6 hours to obtain (a) a solution having a film property-providing polymer (solid content: 45.5% by weight) having a weight average molecular weight of 80,000 and an acid value of 130 mgKOH/g.

TABLE 1

| | Material | Formulation amount |
|---|---|---|
| P | Ethylene glycol monomethyl ether | 70 parts by weight |
| | Toluene | 50 parts by weight |
| Q | Methacrylic acid | 20 parts by weight |
| | Methyl methacrylate | 55 parts by weight |
| | Ethyl acrylate | 15 parts by weight |
| | n-Butyl methacrylate | 10 parts by weight |
| | 2,2'-Azobis(isobutyronitrile) | 0.5 parts by weight |

Preparation Example 2

(Preparation of Solution (A-1) for (A) photosensitive resin composition layer containing phosphor)

The materials shown in Table 2 were mixed for 15 minutes by using a stirrer to prepare Solution (A-1) for (A) a photosensitive resin composition layer containing a red color forming phosphor.

TABLE 2

| Material | Formulated amount |
|---|---|
| (a) Solution having film property providing polymer obtained in Preparation example 1 | 132 parts by weight (solid content: 60 parts by weight) |
| Polypropylene glycol dimethacrylate (average number of propylene oxide: 12) | 40 parts by weight |
| 2-Benzyl-2-dimethylamino-1-(4-morpholinophenyl)-butanone-1 | 1 parts by weight |
| $Y_2O_2S$:Eu | 140 parts by weight |
| Methyl ethyl ketone | 30 parts by weight |

Preparation Example 3

(Preparation of Solution (A-2) for (A) photosensitive resin composition containing phosphor)

The materials shown in Table 2 were mixed for 15 minutes by using a stirrer to prepare Solution (A-2) for (A) a photosensitive resin composition layer containing a blue color forming phosphor.

TABLE 3

| Material | Formulated amount |
|---|---|
| (a) Solution having film property providing polymer obtained in Preparation example 1 | 132 parts by weight (solid content: 60 parts by weight) |
| Polypropylene glycol dimethacrylate (average number of propylene oxide: 12) | 40 parts by weight |
| 2-Benzyl-2-dimethylamino-1-(4-morpholinophenyl)-butanone-1 | 2 parts by weight |
| ZnSi:Ag | 110 parts by weight |
| Malonic acid | 0.4 part by weight |
| Methyl ethyl ketone | 30 parts by weight |

Preparation Example 4

(Preparation of Solution (A-3) for (A) photosensitive resin composition containing phosphor)

The materials shown in Table 2 were mixed for 15 minutes by using a stirrer to prepare Solution (A-3) for (A) a photosensitive resin composition layer containing a green color forming phosphor.

TABLE 4

| Material | Formulated amount |
|---|---|
| (a) Solution having film property providing polymer obtained in Preparation example 1 | 132 parts by weight (solid content: 60 parts by weight) |
| Polypropylene glycol dimethacrylate (average number of propylene oxide: 12) | 40 parts by weight |
| 2-Benzyl-2-dimethylamino-1-(4-morpholinophenyl)-butanone-1 | 2 parts by weight |
| ZnS: Cu,Au,Al | 120 parts by weight |
| Malonic acid | 0.4 part by weight |
| Methyl ethyl ketone | 30 parts by weight |

Example 1

(Preparation of photosensitive element (i))

Solution (A-1) for (A) a photosensitive resin composition layer containing a red color forming phosphor obtained in Preparation example 2 was uniformly coated on the surface of a polyethylene terephthalate film with a thickness of 50 μm, and dried with a hot air convection type drier at 110° C. for 10 minutes to remove the solvent whereby (A) the photosensitive resin composition layer containing a phosphor was formed. The thickness of the resulting (A) photosensitive resin composition layer containing a phosphor was 15 μm.

Then, on (A) the photosensitive resin composition layer containing a phosphor, a polyethylene film with a thickness of 25 μm was further laminated as a cover film to prepare a photosensitive element (i).

Edge fusion property of the resulting photosensitive element (i) was evaluated by the following method and the results are shown in Table 5.

(Edge fusion property)

The photosensitive element (i) with a length of 90 m wound-up in a roll state was stored at the temperature of 23° C. and the humidity of 60% Rh (relative humidity), and the exuded state of the photosensitive layer from the side surface of the roll was evaluated with eyes for 6 months. Evaluation standard is as follows.

○: Edge fusion property is good (the photosensitive layer was not exuded after 6 months)

X: Edge fusion property is bad (the photosensitive layer was exuded after 6 months)

Example 2

(Preparation of photosensitive element (ii))

In the same manner as in Example 1 except for changing Solution (A-1) for (A) a photosensitive resin composition layer containing a red color forming phosphor obtained in Preparation example 2 used in Example 1 to Solution (A-2) for (A) a photosensitive resin composition layer containing a blue color forming phosphor obtained in Preparation example 3, a photosensitive element (ii) was prepared. The thickness of the resulting (A) photosensitive resin composition layer containing a phosphor of the photosensitive element (ii) was 15 μm.

Edge fusion property of the resulting photosensitive element (ii) was evaluated in the same manner as in Example 1 and the results are shown in Table 5.

Example 3

(Preparation of photosensitive element (iii))

In the same manner as in Example 1 except for changing Solution (A-1) for (A) a photosensitive resin composition layer containing a red color forming phosphor obtained in Preparation example 2 used in Example 1 to Solution (A-3) for (A) a photosensitive resin composition layer containing a green color forming phosphor obtained in Preparation example 4, a photosensitive element (iii) was prepared. The thickness of the resulting (A) photosensitive resin composition layer containing a phosphor of the photosensitive element (iii) was 15 μm.

Edge fusion property of the resulting photosensitive element (iii) was evaluated in the same manner as in Example 1 and the results are shown in Table 5.

TABLE 5

| | Photosensitive element | (A) Photosensitive resin composition layer containing phosphor | Edge fusion property |
|---|---|---|---|
| Example 1 | (i) | (A-1) | ○ |
| Example 2 | (ii) | (A-2) | ○ |
| Example 3 | (iii) | (A-3) | ○ |

From the results shown in Table 5, edge fusion properties of the photosensitive elements obtained in Examples 1 to 3 were all good.

Preparation Example 5

(Preparation of Film (B-1) having (B) filling layer)

A resin solution comprising a material shown in Table 6 was uniformly coated on a polyethylene terephthalate film having a thickness of 20 μm, and dried with a hot air convection type drier at 80 to 110° C. for 10 minutes to remove distilled water whereby (B) the filling layer was formed. The thickness of the resulting (B) filling layer after drying was 40 μm.

Then, on (B) the filling layer, a polyethylene terephthalate film having a thickness of 25 μm was laminated to prepare a film (B-1) having (B) the filling layer which comprises the support film, (B) the filling layer and the cover film.

TABLE 6

| Materials | Formulated amount |
|---|---|
| Polyvinyl alcohol (produced by Kuraray, PVA205, hydrolyzed ratio = 80%) | 17.3 parts by weight |
| Distilled water | 28 parts by weight |

Preparation Example 6

(Preparation of Film (B-2) having (B) filling layer)

A resin solution comprising a material shown in Table 7 was uniformly coated on a polyethylene terephthalate film having a thickness of 20 μm, and dried with a hot air convection type drier at 80 to 110° C. for 10 minutes to remove the solvent whereby (B) the filling layer was formed. The thickness of the resulting (B) filling layer after drying was 30 μm.

Then, on (B) the filling layer, a polyethylene terephthalate film having a thickness of 25 μm was laminated to prepare a film (B-2) having (B) the filling layer which comprises the support film, (B) the filling layer and the cover film.

TABLE 7

| Materials | Formulated amount |
|---|---|
| Ethylene/ethyl acrylate copolymer (65/35 (weight ratio)) (Everflex EEA709, produced by Mitsui Du'Pont K.K.) | 30 parts by weight |
| Toluene | 70 parts by weight |

Example 4

(Preparation of photosensitive element (iv))

While peeling off each of polyethylene films of the photosensitive element (I) having (A) the photosensitive resin composition layer containing a phosphor obtained in Example 1 and of the film (B-2) having (B) the filling layer obtained in Preparation example 6, these materials were laminated by a lamination temperature of 20° C., a lamination rate of 0.5 m/min and a bonding pressure (cylinder pressure) of $5\times10^4$ Pa (since a film with the width of 10 cm was used, the linear pressure at this time was $1.2\times10^3$ N/m) to prepare a photosensitive element (iv) having (A) the photosensitive resin composition layer containing a phosphor and (B) the filling layer.

Example 5

(Preparation of photosensitive element (v))

In the same manner as in Example 4 except for changing the photosensitive element (i) having (A) the photosensitive resin composition layer containing a phosphor obtained in Example 1 used in Example 4 to the photosensitive element (ii) having (A) the photosensitive resin composition layer containing a phosphor obtained in Example 2, a photosensitive element (v) having (A) the photosensitive resin composition layer containing a phosphor and (B) the filling layer was prepared.

Example 6

(Preparation of photosensitive element (vi))

In the same manner as in Example 4 except for changing the photosensitive element (i) having (A) the photosensitive resin composition layer containing a phosphor obtained in Example 1 used in Example 4 to the photosensitive element (iii) having (A) the photosensitive resin composition layer containing a phosphor obtained in Example 3, a photosensitive element (vi) having (A) the photosensitive resin composition layer containing a phosphor and (B) the filling layer was prepared.

Example 7

(Preparation of photosensitive element (vii))

In the same manner as in Example 6 except for changing the film (B-2) having (B) the filling layer obtained in Preparation example 6 used in Example 4 to the film (B-1) having (B) the filling layer obtained in Preparation example 5, a photosensitive element (vii) having (A) the photosensitive resin composition layer containing a phosphor and (B) the filling layer was prepared.

Example 8

(Preparation of substrate (1) to which (A) the photosensitive resin composition layer containing a phosphor is formed)

While peeling off the polyethylene terephthalate film of the photosensitive element (iv) obtained in Example 4 at the surface of contacting with (A) the photosensitive resin composition layer containing a phosphor, it was laminated to a conductive layer side of a FED phosphor layer formed substrate to which the conductive layer and a black matrix had bee formed with a lamination temperature of 120° C., a lamination rate of 0.5 m/min and a bonding pressure (cylinder pressure) of $4\times10^5$ Pa (since a substrate with the width of 10 cm was used, the linear pressure at this time was $9.8\times10^3$ N/m) to prepare a substrate (1) to which (A) the photosensitive resin composition layer containing a phosphor and (B) the filling layer were laminated.

The resulting substrate (1) was cut and the cutting surface was observed by electron microscope. When the film forming property of (A) the photosensitive resin composition layer containing a phosphor was confirmed, it can be understood that a uniform and good (A) the photosensitive resin composition layer containing a phosphor had been formed.

Example 9

(Preparation of substrate (2) to which (A) the photosensitive resin composition layer containing a phosphor is formed)

In the same manner as in Example 8 except for changing the photosensitive element (iv) obtained in Example 4 used in Example 8 to the photosensitive element (v) obtained in Example 5, a substrate (2) to which (A) the photosensitive resin composition layer containing a phosphor and (B) the filling layer were laminated was prepared.

The resulting substrate (2) was cut and the cutting surface was observed by electron microscope. When the film forming property of (A) the photosensitive resin composition layer containing a phosphor was confirmed, it can be understood that a uniform and good (A) the photosensitive resin composition layer containing a phosphor had been formed.

Example 10

(Preparation of substrate (3) to which (A) the photosensitive resin composition layer containing a phosphor is formed)

In the same manner as in Example 8 except for changing the photosensitive element (iv) obtained in Example 4 used in Example 8 to the photosensitive element (vi) obtained in Example 6, a substrate (3) to which (A) the photosensitive resin composition layer containing a phosphor and (B) the filling layer were laminated was prepared.

The resulting substrate (3) was cut and the cutting surface was observed by electron microscope. When the film forming property of (A) the photosensitive resin composition layer containing a phosphor was confirmed, it can be understood that a uniform and good (A) the photosensitive resin composition layer containing a phosphor had been formed.

Example 11

(Preparation of substrate (4) to which (A) the photosensitive resin composition layer containing a phosphor is formed)

In the same manner as in Example 8 except for changing the photosensitive element (iv) obtained in Example 4 used in Example 8 to the photosensitive element (vii) obtained in Example 7, a substrate (4) to which (A) the photosensitive resin composition layer containing a phosphor and (B) the filling layer were laminated was prepared.

The resulting substrate (4) was cut and the cutting surface was observed by electron microscope. When the film forming property of (A) the photosensitive resin composition layer containing a phosphor was confirmed, it can be understood that a uniform and good (A) the photosensitive resin composition layer containing a phosphor had been formed.

(Preparation of phosphor pattern for field emission display panel)

Example 12

<Preparation of red pattern>

(I) Step of forming (A) photosensitive resin composition layer containing phosphor on substrate to which conductive layer was formed In the same manner as in Example 8, on the substrate to which a conductive layer was formed, (A) the photosensitive resin composition layer containing a phosphor and (B) the filling layer were laminated, and then the polyethylene terephthalate film and (B) the filling layer were removed.

(II) Step of irradiating active light to (A) the photosensitive resin composition layer containing a phosphor selectively Then, onto (A) the photosensitive resin composition layer containing a phosphor, a photomask for test was closely contacted and active light was selectively irradiated with 500 mJ/cm$^2$ by using HMW-590 type exposure machine (trade name, available from ORC Seisakusho).

(III) Step of selectively removing (A) the photosensitive resin composition layer containing a phosphor to which active light was selectively irradiated by development Then, after irradiation of the active light, the material was allowed to stand at normal temperature for one hour, spray development was carried out by using 1% by weight of a sodium carbonate aqueous solution at 30° C. for 120 seconds.

After the development, the material was dried at 80° C. for 10 minutes, and by using Toshiba Ultraviolet ray irradiating machine available from Toshiba Denzai K.K., irradiation with an ultraviolet ray at a dose of 3 J/cm$^2$ was carried out and the material was further heated in a drying chamber at 150° C. for one hour.

<Preparation of blue pattern>

(I) Step of forming (A) photosensitive resin composition layer containing phosphor on substrate to which conductive layer was formed In the same manner as in Example 9, on the substrate to which a conductive layer was formed, (A) the photosensitive resin composition layer containing a phosphor and (B) the filling layer were laminated, and then the polyethylene terephthalate film and (B) the filling layer were removed.

(II) Step of irradiating active light to (A) the photosensitive resin composition layer containing a phosphor selectively Then, onto (A) the photosensitive resin composition layer containing a phosphor, a photomask for test was closely contacted and active light was selectively irradiated with 500 mJ/cm$^2$ by using HMW-590 type exposure machine (trade name, available from ORC Seisakusho).

(III) Step of selectively removing (A) the photosensitive resin composition layer containing a phosphor to which active light was selectively irradiated by development Then, after irradiation of the active light, the material was allowed to stand at normal temperature for one hour, spray development was carried out by using 1% by weight of a sodium carbonate aqueous solution at 30° C. for 120 seconds.

After the development, the material was dried at 80° C. for 10 minutes, and by using Toshiba Ultraviolet ray irradiating machine available from Toshiba Denzai K.K., irradiation with an ultraviolet ray at a dose of 3 J/cm$^2$ was carried out and the material was further heated in a drying chamber at 150° C. for one hour.

<Preparation of green pattern>

(I) Step of forming (A) photosensitive resin composition layer containing phosphor on substrate to which conductive layer was formed In the same manner as in Example 10, on the substrate to which a conductive layer was formed, (A) the photosensitive resin composition layer containing a phosphor and (B) the filling layer were laminated, and then the polyethylene terephthalate film and (B) the filling layer were removed.

(II) Step of irradiating active light to (A) the photosensitive resin composition layer containing a phosphor selectively Then, onto (A) the photosensitive resin composition layer containing a phosphor, a photomask for test was closely contacted and active light was selectively irradiated with 500 mJ/cm$^2$ by using HMW-590 type exposure machine (trade name, available from ORC Seisakusho).

(III) Step of selectively removing (A) the photosensitive resin composition layer containing a phosphor to which active light was selectively irradiated by development Then, after irradiation of the active light, the material was allowed to stand at normal temperature for one hour, spray development was carried out by using 1% by weight of a sodium carbonate aqueous solution at 30° C. for 120 seconds.

After the development, the material was dried at 80° C. for 10 minutes, and by using Toshiba Ultraviolet ray irradiating machine available from Toshiba Denzai K.K., irradiation with an ultraviolet ray at a dose of 3 J/cm$^2$ was carried out and the material was further heated in a drying chamber at 150° C. for one hour.

(IV) Step of forming phosphor pattern by removing unnecessary portion from the above-mentioned pattern by calcination The FED phosphor layers-formed substrate in which a multi-colored pattern comprising red, blue and green had been formed on the conductive layer and the black matrix was treated by a Lewis acid solution, then subjected to heat treatment (calcination) at 500° C. for 30 minutes to remove the unnecessary resin component to obtain a transmission type FED front panel provided with the phosphor pattern for a field emission display panel.

The sectional view of the resulting transmission type FED front panel was observed by stereomicroscope and SEM and the shapes of the phosphor patterns were evaluated. As the results, the multi-colored phosphor pattern comprising red, blue and green showed no defects in any of the three colors and formed with good adhesiveness.

Example 13

(Preparation of transmission type field emission display panel)

By using the transmission type FED front panel obtained in Example 12, the transmission type field emission display panel shown in FIG. 6 was prepared according to the conventionally known method.

When the resulting transmission type field emission display panel lighted by the conventionally known method, high efficiency emission luminance and uniform panel display were observed.

According to the process for producing the phosphor pattern for the field emission display panel of the present invention, a phosphor pattern for a field emission display panel can be formed on a substrate such as a substrate for forming a phosphor layer for a field emission display panel on which a conductive layer is formed with good mass productivity, high precision and uniform shape.

According to the process for producing the phosphor pattern for the field emission display panel of the present invention, a process for preparing a phosphor pattern for a field emission display panel with excellent workability and environmental safety can be provided.

According to the process for producing the phosphor pattern for the field emission display panel of the present invention, decrease in a film thickness can be restrained and excellent photosensitivity can be obtained.

According to the photosensitive element for a field emission display panel of the present invention, restraint of edge fusion and handling property are excellent, and a phosphor pattern having high precision, uniform shape and excellent photosensitivity with good workability can be formed.

According to the phosphor pattern for a field emission display panel of the present invention, high precision, uniform shape and excellent in luminance can be obtained.

According to the field emission display panel provided with a phosphor pattern for a field emission display panel of the present invention, field emission display panel having a high precision, uniform shape and excellent in luminance can be obtained.

What is claimed is:

1. A process for forming a phosphor pattern for a field emission display panel, comprising the steps of:

(I) forming (A) a photosensitive resin composition layer containing a phosphor on a substrate onto which a conductive layer was previously applied, wherein the step (I) is:

(Ib') a step of placing a photosensitive element having (B) a filling layer on a support film and (A) the photosensitive resin composition layer containing the phosphor thereon on the substrate onto which the conductive layer was previously applied so as to contact (A) the photosensitive resin composition layer containing the phosphor with the substrate onto which the conductive layer was previously applied, and applying pressure to (B) the filling layer to laminate (A) the photosensitive resin composition layer containing the phosphor and (B) the filling layer on the substrate onto which the conductive layer was previously applied, and (Ic) a step of removing (B) the filling layer;

(II) selectively irradiating active light to (A) the photosensitive resin composition layer containing the phosphor, for forming a pattern;

(III) selectively removing (A) the photosensitive resin composition layer containing the phosphor to which active light has been selectively irradiated by development to form the pattern; and (IV) calcining the pattern to remove an unnecessary portion to form the phosphor pattern, wherein (A) said photosensitive resin composition layer containing the phosphor contains:

(a) a polymer having a film-forming property, (b) a photopolymerizable unsaturated compound having an ethylenically unsaturated group, (c) a photoinitiator forming a free radical by irradiation of active light, and (d) the phosphor.

2. A process for forming a phosphor pattern for a field emission display panel according to claim 1, wherein said unnecessary portion is a portion of the pattern other than the phosphor and a binder formed from the photosensitive resin composition of the photosensitive resin composition layer.

3. A process for forming a phosphor pattern for a field emission display panel according to claim 1, wherein said photosensitive resin composition layer containing the phosphor is formed on the substrate by forming a layer of the photosensitive resin composition, and then providing said layer of the photosensitive resin composition on the substrate.

4. A process for forming a phosphor pattern for a field emission display panel according to claim 1, wherein viscosity of the photosensitive resin composition of the photosensitive resin composition layer, at 100° C, is in a range of 1 Pa·sec to $1\times10^9$ Pa·sec.

5. A process for forming a phosphor pattern for a field emission display panel according to claim 1, wherein said polymer is included in the photosensitive resin composition layer in an amount of 10–90 parts by weight based on the total weight of the polymer and the photopolymerizable unsaturated compound.

6. A process for preparing a phosphor pattern for a field emission display panel wjocj comprises the steps of:

(I) forming (A) a photosensitive resin composition layer containing a phosphor on a substrate onto which a conductive layer was previously applied, wherein the step (I) is:

(Ib) a step of placing, on the substrate onto which the conductive layer was previously applied, (B) a filling layer on (A) the photosensitive resin composition layer containing a phosphor and in such a state, applying pressure to (B) the filling layer to laminate (A) the photosensitive resin composition layer containing a phosphor and (B) the filling layer on the substrate onto which the conductive layer was previously applied, and (Ic) a step of removing (B) the filling layer;

(II) selectively irradiating active light to (A) the photosensitive resin composition layer containing a phosphor;

(III) selectively removing (A) the photosensitive resin composition layer containing a phosphor to which active light has been selectively irradiated by development, to form a pattern; and (IV) calcining the pattern to remove an unnecessary portion, to form a phosphor pattern.

7. A process for preparing a phosphor pattern for a field emission display panel according to claim 6, wherein the step (I) is (Ib') a step of placing the photosensitive element having (B) the filling layer on a support film and (A) the photosensitive resin composition layer containing a phosphor thereon on the substrate onto which the conductive layer was previously applied so as to contact (A) the photosensitive resin composition layer containing a phosphor with the substrate onto which the conductive layer was previously applied, applying pressure to (B) the filling layer to laminate (A) the photosensitive resin composition layer containing a phosphor and (B) the filling layer on the substrate onto which the conductive layer was previously applied, and (Ic) a step or removing (B) the filling layer.

8. A process for preparing a phosphor pattern for a field emission display panel according to claim 7, wherein the respective steps of (I) to (III) are repeated to form a multi-colored pattern comprising photosensitive composition layers containing phosphors which are colored to red, green and blue, and then subjecting to the step of (IV) to form a multi-colored phosphor pattern.

9. A process for preparing a phosphor pattern for a field emission display panel according to claim 7, wherein the respective steps of (I) to (IV) are repeated to form a multi-colored pattern comprising photosensitive resin composition layers containing phosphors which are colored to red, green, and blue.

10. A process for preparing a phosphor pattern for a field emission display panel according to claim 9, wherein (A) said photosensitive resin composition layer containing a phosphor contains:

(a) a polymer having a film-forming property, (b) a photpolymerizable unsaturated compound having an ethylenically unsaturated group, (c) a photoinitiator forming a free radical by irradiation of active light, and (d) a phosphor.

11. A process for preparing a phosphor pattern for a field emission display panel according to claim 6, wherein the respective steps of (I) to (III) are repeated to form a multi-colored pattern comprising photosensitive resin composition layers containing phosphors which are colored to red, green and blue, and then subjecting to the step of (IV) to form a multi-colored phosphor pattern.

12. A process for preparing a phosphor pattern for a field emission display panel according to claim 6, wherein the respective steps of (I) to (IV) are repeated to form a multi-colored pattern comprising photosensitive resin composition layers containing phosphors which are colored to red, green and blue.

13. A process for preparing a phosphor pattern for a field emission display panel according to claim 6, wherein (A) said photosensitive resin composition layer containing a phosphor contains:

(a) a polymer having a film-forming property.

(b) a photopolymerizable unsaturated compound having an ethylenically unsaturated group, (c) a photoinitiator forming a free radical by irradiation of active light, and (d) a phospor.

* * * * *